US007793385B2

(12) United States Patent
Huffman

(10) Patent No.: US 7,793,385 B2
(45) Date of Patent: Sep. 14, 2010

(54) EXTRACTION CLEANING WITH AIR FLOW DRYING

(75) Inventor: Eric C. Huffman, Lowell, MI (US)

(73) Assignee: BISSELL Homecare Inc., Grand Rapids, MI (US)

( * ) Notice: Subject to any disclaimer, the term of this patent is extended or adjusted under 35 U.S.C. 154(b) by 1126 days.

(21) Appl. No.: 11/275,471

(22) Filed: Jan. 6, 2006

(65) Prior Publication Data

US 2007/0094835 A1 May 3, 2007

Related U.S. Application Data

(60) Provisional application No. 60/593,358, filed on Jan. 7, 2005.

(51) Int. Cl.
*A47L 7/04* (2006.01)
*A47L 9/08* (2006.01)

(52) U.S. Cl. ..... 15/320; 15/353

(58) Field of Classification Search ..... 15/320, 15/344, 345, 353
See application file for complete search history.

(56) References Cited

U.S. PATENT DOCUMENTS 3,663,984 A * 5/1972 Anthony et al. ..... 15/321
5,237,720 A 8/1993 Blase et al.
5,289,610 A * 3/1994 Monson ..... 15/320
5,507,068 A * 4/1996 Fan et al. ..... 15/320
5,548,905 A 8/1996 Kuma et al.
5,587,021 A * 12/1996 Hoersch et al. ..... 134/1
5,813,086 A 9/1998 Ueno et al.
5,979,013 A 11/1999 Beckey et al.
5,992,051 A 11/1999 Salehibakhsh
6,131,237 A 10/2000 Kasper et al.
6,298,578 B1 10/2001 Frampton
6,345,411 B1 * 2/2002 Kato et al. ..... 15/412
6,425,958 B1 * 7/2002 Giddings et al. ..... 134/21
6,467,122 B2 10/2002 Lenkiewicz et al.
6,505,379 B2 1/2003 Keller
6,560,817 B2 * 5/2003 Deiterman et al. ..... 15/320
7,000,286 B2 * 2/2006 Wang ..... 15/320
7,302,733 B2 * 12/2007 Rau et al. ..... 15/320
7,356,875 B2 * 4/2008 Abdallah et al. ..... 15/345
2003/0014829 A1 * 1/2003 Wang ..... 15/320
2005/0166358 A1 * 8/2005 Lee et al. ..... 15/320
2007/0056136 A1 3/2007 Stephens et al.

* cited by examiner

*Primary Examiner*—David B Thomas
(74) *Attorney, Agent, or Firm*—McGarry Blair PC

(57) ABSTRACT

A portable cleaning apparatus comprises a base module for movement along a surface, the base module having a front portion, an upright handle pivotally attached to the base module, a cleaning liquid dispensing system for applying a cleaning liquid to a surface to be cleaned, an agitation assembly associated with the base module, and a vacuum inlet associated with the base module, the improvement comprising a blower assembly associated with one of the base module and the upright handle for blowing air tangentially across the surface to dry the surface.

22 Claims, 7 Drawing Sheets

EXTRACTION CLEANING WITH AIR FLOW DRYING

CROSS-REFERENCE TO RELATED APPLICATION

This application claims the benefit of U.S. provisional application Ser. No. 60/593,358, filed Jan. 7, 2005, which is incorporated herein in its entirety.

BACKGROUND OF THE INVENTION

1. Field of the Invention

This invention relates to extraction cleaning. In one of its aspects, the invention relates to an extraction cleaning machine with drying of a surface to be cleaned. In another of its aspects, the invention relates to an upright extraction cleaning machine with drying of a surface to be cleaned. In another of its aspects, the invention relates to extraction cleaning with air flow drying of a surface to be cleaned.

2. Description of the Related Art

Upright extraction cleaning machines have been used for removing dirt from surfaces such as carpeting and hard floors. The known extraction cleaning machines can be in the form of a canister-type unit, as disclosed in U.S. Pat. No. 5,237,720 to Blase et al., or an upright unit, as disclosed in U.S. Pat. No. 6,131,237 to Kasper et al.

Either type of unit contains a fluid delivery system for depositing a quantity of cleaning solution on the surface to be cleaned. The cleaning solution dissolves the dirt, removes the dirt from the surface, and places the dirt in suspension, which aids in the vacuum removal of the dirt from the surface. Although the cleaning solution and suspended dirt are removed from the surface, the surface remains wet, and cannot typically be used until it dries. The drying time may be significant, perhaps several hours in duration, depending on the surface type. For carpeted surfaces, the thickness of the carpet pile, the hydrophilic properties of the carpet fibers, the degree of saturation of the carpet, the ambient air relative humidity and circulation, and the like all affect the speed at which the carpet dries. While the surface is drying, furniture that has been removed cannot be replaced, traffic must be diverted to other locations or interrupted, and the area cannot be used, which may cause unacceptable interruptions in necessary activities, such as commercial, educational, or institutional activities.

U.S. Pat. No. 5,813,086 to Ueno et al. discloses a cleaner comprising a suction nozzle for removing excess cleaning liquid from the carpet and an adjacently located blower nozzle which delivers heated air downwardly onto the carpet after the suction nozzle has removed the excess liquid.

U.S. Pat. No. 6,505,379 to Keller discloses a carpet extractor head fluidly connected to an external vacuum and pressurized air source, wherein drying air is delivered through an interior conduit in the head to the carpet and is evacuated through a conduit surrounding the interior conduit.

U.S. Pat. No. 6,298,578 to Frampton discloses a mobile water evacuating and surface drying device having a blower nozzle to deliver heated air downwardly onto the surface after a suction nozzle has removed excess liquid.

U.S. Pat. No. 5,992,051 to Salehibakhsh discloses a carpet drying apparatus comprising a hollow plate fluidly connected to a regularly-spaced array of elongated, hollow needles which are inserted into a carpet to deliver compressed air through the needles and into the carpet.

U.S. Pat. No. 5,548,905 to Kuma et al. discloses a stationary conveyor belt apparatus for drying mats, carpet pieces, and the like that are moved on a moving belt through a vacuum and compressed air drying station. The vacuum and compressed air nozzles are in contact with the mat/carpet piece to draw air through the carpet.

SUMMARY OF THE INVENTION

A portable cleaning apparatus comprises a housing for movement along a surface; a cleaning liquid dispensing system mounted in the housing for applying a cleaning liquid to a surface to be cleaned; and a suction nozzle and a suction source both mounted on the housing and the suction source having an inlet functionally connected to the suction nozzle for removing liquid from the surface to be cleaned. According to the invention, a blower assembly is mounted on the housing for blowing air tangentially across the surface to be cleaned to dry the surface subsequent to the removal of liquid from the surface.

In a preferred embodiment of the invention, the suction source includes a motor, the housing has an opening in fluid communication with the motor for cooling the motor and the blower assembly is in fluid communication with the motor to draw motor cooling air from the motor.

In another embodiment of the invention, the blower assembly is fluidly connected to an outlet of the suction source.

In another embodiment of the invention, the blower assembly further comprises a heating element for heating the air prior to blowing the air across the surface.

The blower assembly is capable of blowing the air tangentially across the surface at a wide range of rates, however the greater the flow rate, the better the drying performance. Typically the rate of air flow across the surface is at least 20 cubic feet per minute, preferably in the range of between 20 and 100 cubic feet per minute and typically about 30 cubic feet per minute.

In another embodiment of the invention, the housing has a forward and reward portion and the housing is adapted for movement in forward and rearward directions and the blower assembly has an outlet opening in a side portion to blow the air in a direction transverse to the forward and rearward directions of movement of the housing.

In another embodiment of the invention, the housing has a forward and reward portion and the housing is adapted for movement in forward and rearward directions and the blower assembly has an outlet opening in a forward and rearward portion to blow the air in a either a forward or rearward direction or in both a forward and rearward direction.

The invention is applicable to many different types of extractors. In one embodiment, the housing includes a base module that is adapted to move along the surface to be cleaned and an upright handle pivotally attached to the base module; and the blower assembly outlet opening is positioned in the base module. In another embodiment of the invention, the housing includes a base module that is adapted to move along the surface to be cleaned and an upright handle pivotally attached to the base module; and the blower assembly outlet opening is position on the handle.

Still further the invention comprises a method for cleaning a surface comprising the steps of depositing a cleaning fluid on the surface; entraining dirt and debris in the cleaning fluid; extracting the cleaning fluid with the entrained dirt and debris from the surface and collecting the extracted cleaning fluid with the entrained dirt and debris. According to the invention, subsequent to the extracting step, air is blown air across the surface to dry the cleaning fluid from the surface.

In a preferred embodiment of the invention, the depositing, extracting, collecting and blowing steps are performed sequentially in a single implement.

In one embodiment, the blowing step is performed exclusively of the depositing, extracting, collecting steps, for example, after an entire room has been cleaned.

In another embodiment of the invention, the depositing step includes the step of sequentially depositing the cleaning fluid along the surface in a first direction and the blowing step includes the step of blowing the air across the surface in a direction transverse to the first direction.

In another embodiment of the invention, the depositing step includes the step of sequentially depositing the cleaning fluid along the surface in a first direction and the blowing step includes the step of blowing the air across the surface in the first direction.

Typically, the air is blown across the surface at a rate of at least 20 cubic feet per minute, preferably at a rate of between 20 and 100 cubic feet per minute and typically at a rate of about 30 cubic feet per minute.

The effectiveness of the cleaning process is enhanced by blowing air at a high flow rate across the carpet surface rather than into the carpet to accelerate the drying of the carpet.

DESCRIPTION OF AN EMBODIMENT OF THE INVENTION

Figure 1:
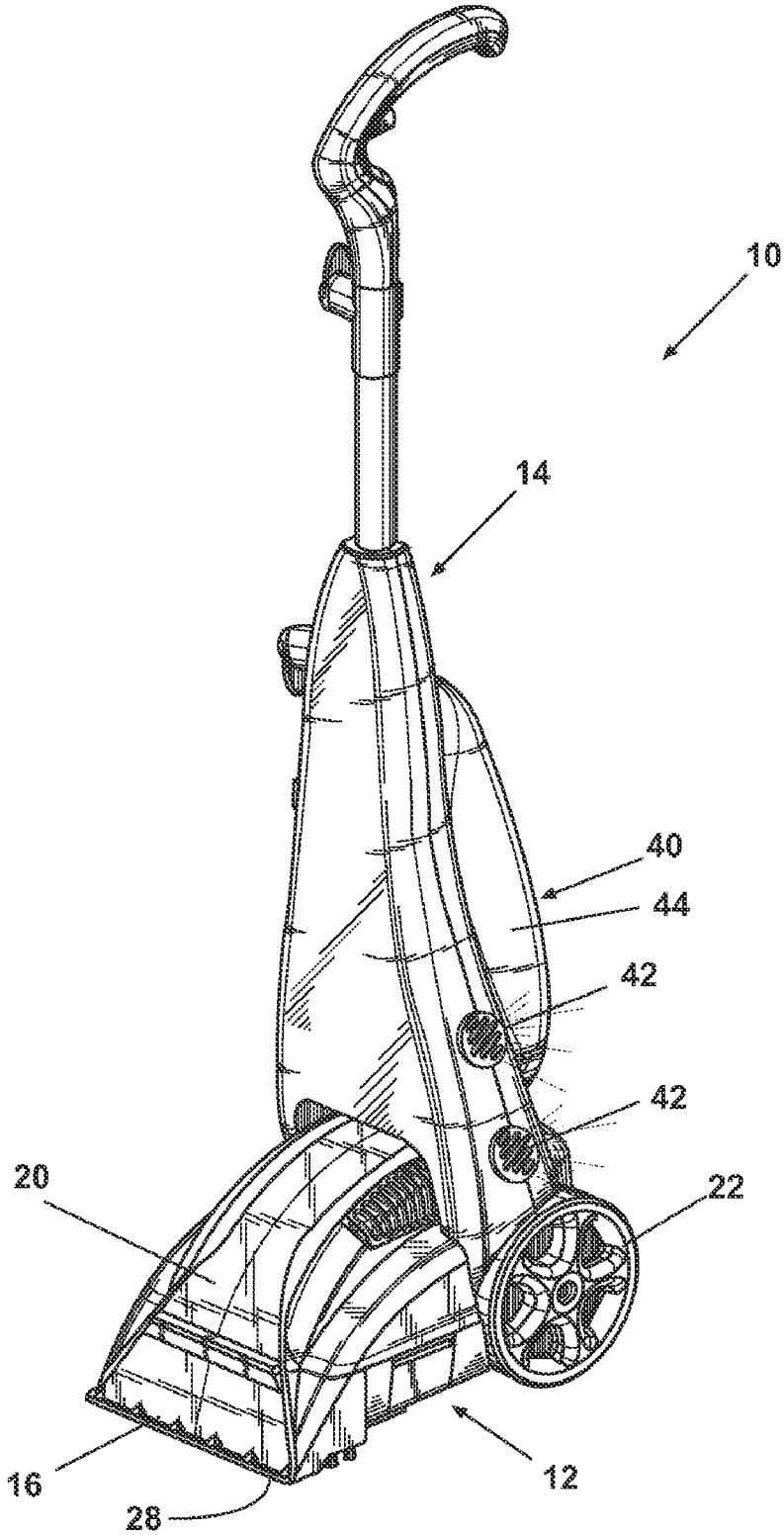
FIG. 1 is a perspective view of an upright extraction cleaning machine comprising a base module and a handle assembly, and a first embodiment of a blower assembly according to the invention.

Referring now to the drawings and to FIG. 1 in particular, a first embodiment of an extraction cleaning machine 10 according to the invention is illustrated. The machine 10 is a portable surface cleaning apparatus including a base module 12 adapted with wheels 22 to roll across a surface to be cleaned, and an upright handle assembly 14 pivotally mounted to a rear portion of the base module 12. The invention is described and illustrated herein with respect to an embodiment comprising an upright extraction cleaning machine, although the invention can also be utilized in a canister-type cleaning machine. The upright extraction cleaning machine 10 is a generally well-known device comprising several of the features and operations described in U.S. Pat. No. 6,131,237 to Kasper et al., which is incorporated herein by reference in its entirety. Such well-known features and operations will not be described in detail herein, except as otherwise necessary for a complete understanding of the invention.

Figure 2:
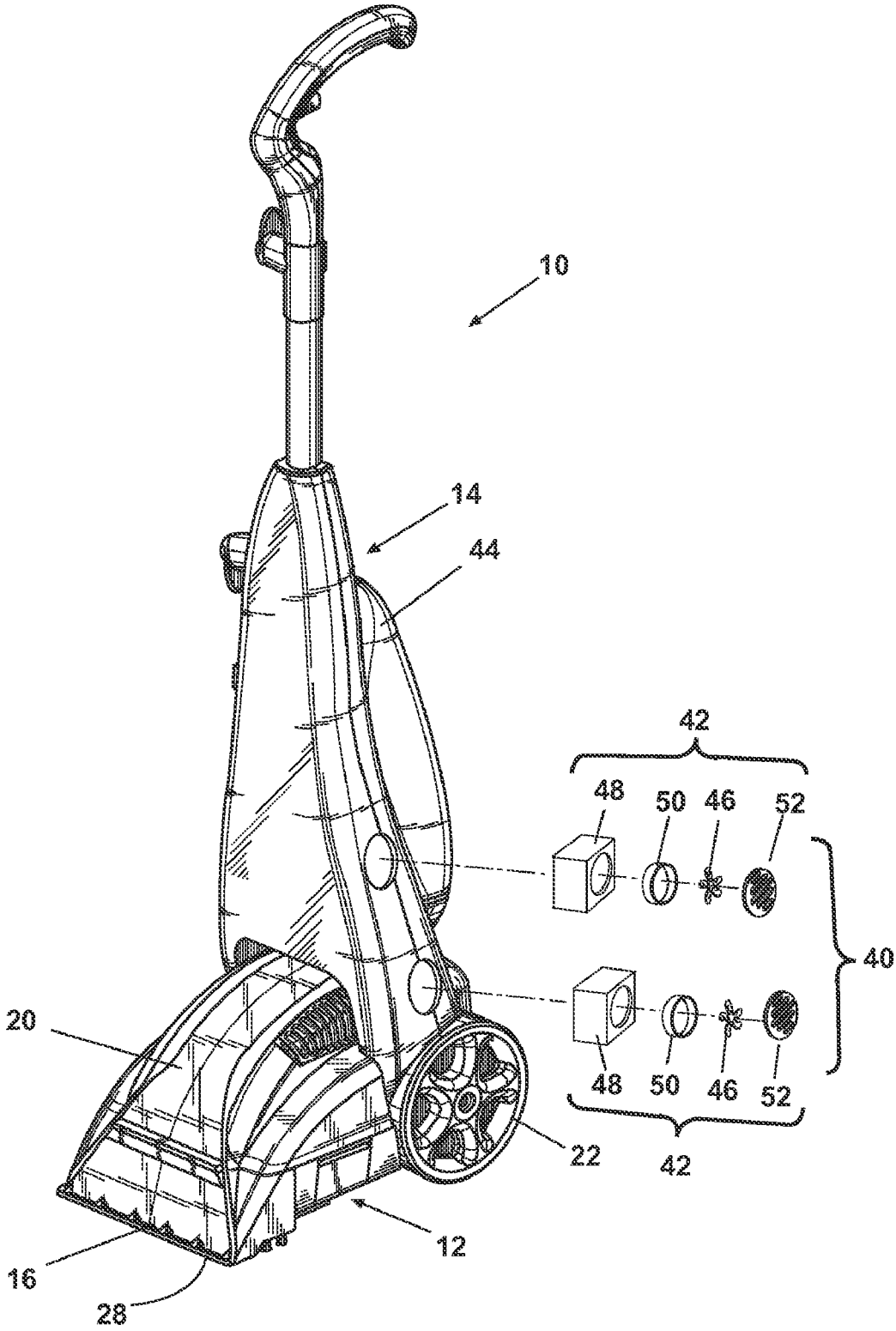
FIG. 2 is a partially exploded view of the upright extraction cleaning machine of FIG. 1 illustrating an assemblage of blowers.

As illustrated in FIGS. 1 and 2, the base module 12 includes a housing 20 having a front portion 16. The housing 20 forms an enclosure for a motor 24 operating a well-known vacuum system 30 for vacuuming liquid from the surface to be cleaned through a vacuum inlet 28, an agitation assembly 26 (FIG. 5), a liquid delivery system comprising a pair of outlet nozzles (not shown) for applying liquid to the surface, liquid reservoirs, and the like.

The embodiment illustrated in FIGS. 1 and 2 comprises a blower assembly 40 mounted to the handle assembly 14, preferably along a rear portion thereof. The blower assembly 40 comprises a plurality of blowers 42 mounted in a blower housing 44. Preferably, the blowers 42 are high-flow blowers capable of a relatively high air flow therethrough. The greater the airflow, the better, however, suitable air flow for the purposes described herein range from 20-100 cubic feet per minute, typically about 30 cubic feet per minute. FIGS. 1 and 2 illustrate a pair of blowers 42 mounted in one lateral wall of the blower housing 44 for delivery of air laterally away from the extraction cleaning machine 10 in a first direction. It will be understood that an identical pair of blowers 42 is mounted in the opposed lateral wall of the blower housing 44 for delivery of air laterally away from the extraction cleaning machine 10 in a second, opposed direction. The first and second directions are transverse to the movement of the extraction cleaning machine 10 along the floor during the cleaning process. Each blower 42 comprises a fan 46 rotatably mounted in a fan housing 48. The fan 46 is illustrated as a propeller-type fan, although other fans, such as a centrifugal fan, would typically be used. The fan housing 48 can enclose a fan motor, a heating element for heating the air delivered by the fan 46, and a control device (not shown) for operating the blower 42. The blower 42 can also comprise a cowl 54 enclosing the fan 46, and a grille 52 attached to the blower housing 44 over the blower 42. The grille 52 can be provided with inclined louvers and rotatably attached to the blower housing 44 to enable the direction of the airflow to be selected by rotating the grille 52.

The blowers 42 can be electrically connected to the power supply for the extraction cleaning machine 10. A user-operated control mechanism (not shown) well-known to a person of ordinary skill in the art can be incorporated into the cleaning machine 10 for selectively operating the blowers 42. For example, the control mechanism can comprise a well-known switching device (not shown) which can operate between an "off" position and one or more "on" positions. The switching device can utilize one or more toggle switches, a rotary switch, pushbuttons, or the like, to select a particular operational condition. For example, with the switching device placed in an "off" position, the blowers 42 will be placed in a deactivated condition. A first switch operating position can activate all blowers 42 for delivery of air to the surface to be cleaned extending along both sides of the cleaning machine 10. A second switch operating position can activate one set of blowers 42 on, for example, the left side of the cleaning machine 10 for delivery of air to the surface extending along the left side of the cleaning machine 10. A third switch operating position can activate the other set of blowers 42 on, for example, the right side of the cleaning machine 10 for delivery of air to the surface extending along the right side of the cleaning machine 10. Additional switch operating positions and/or controls can activate or deactivate the heating elements for selected blowers 42. Fan speeds can be selectively adjusted by other operating positions and/or controls.

The operation of the blowers 42 can also be operationally associated with the operation of the extraction cleaning machine 10. For example, the blowers 42 can be automatically activated when the vacuum and liquid delivery systems are operating. Alternatively, the blowers 42 can be independently activated. Thus, the vacuum and liquid delivery systems can be operated without the blowers 42 activated, and the blowers 42 can be activated without the vacuum and liquid delivery systems operating. In the latter situation, the extraction cleaning machine 10 can be selectively positioned on a wet surface and operated continuously as a blower to dry the surface after cleaning, similar to the use of conventional ventilating fans for drying the surface.

Figure 3:
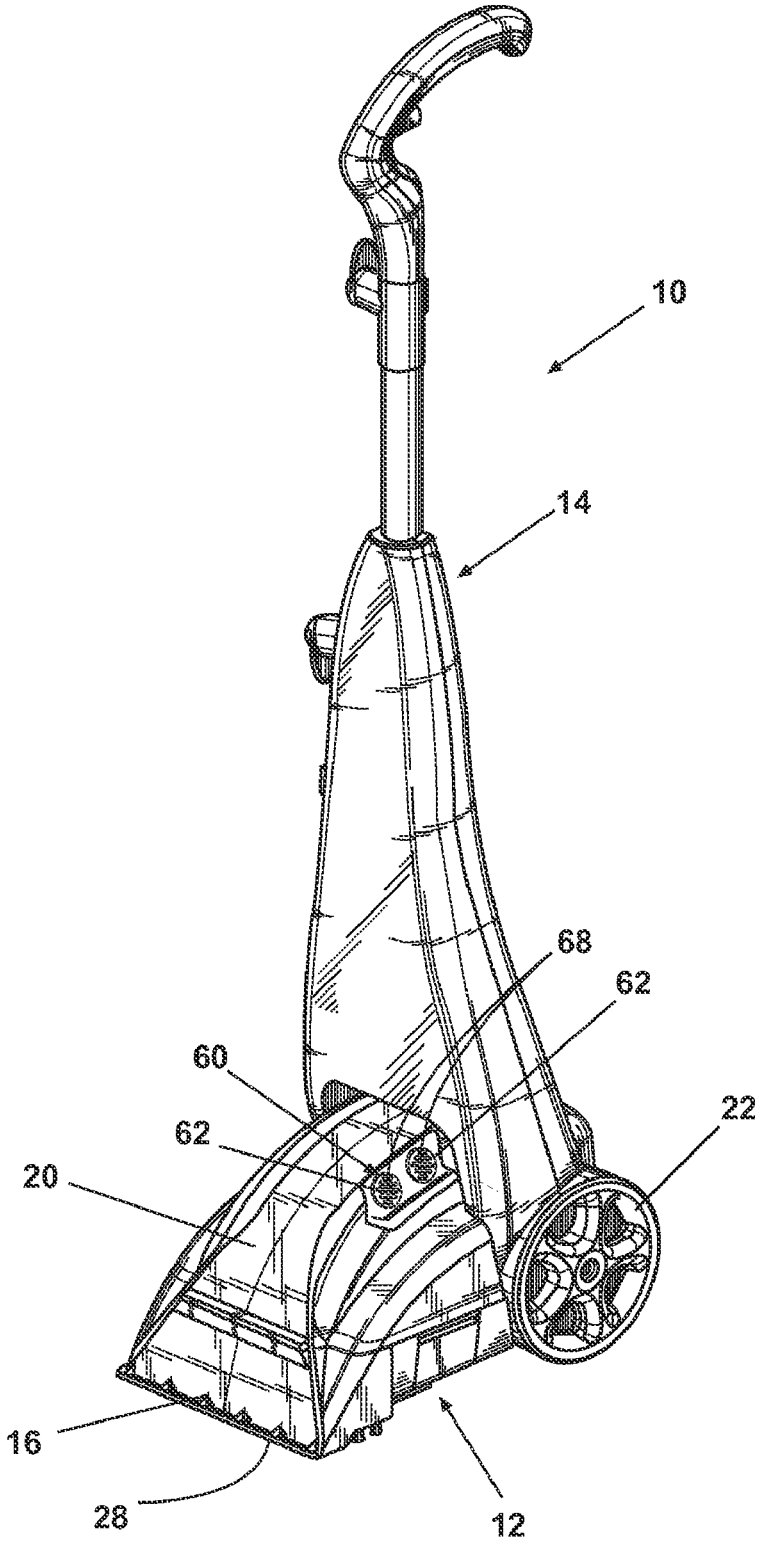
FIG. 3 is a perspective view of an upright extraction cleaning machine comprising a base module and a handle assembly, and a second embodiment of a blower assembly according to the invention.

FIG. 3 illustrates a second embodiment of the blower assembly 60 in which the blowers 62 are mounted in an upper portion of the housing 20. FIG. 3 illustrates a pair of blowers 62 mounted laterally on one side of the housing 20 for delivery of air laterally away from the extraction cleaning machine 10 in a first direction. It will be understood that an identical pair of blowers 62 is mounted on the opposite side of the housing 12 for delivery of air laterally away from the extraction cleaning machine 10 in a second, opposed direction.

Figure 4:
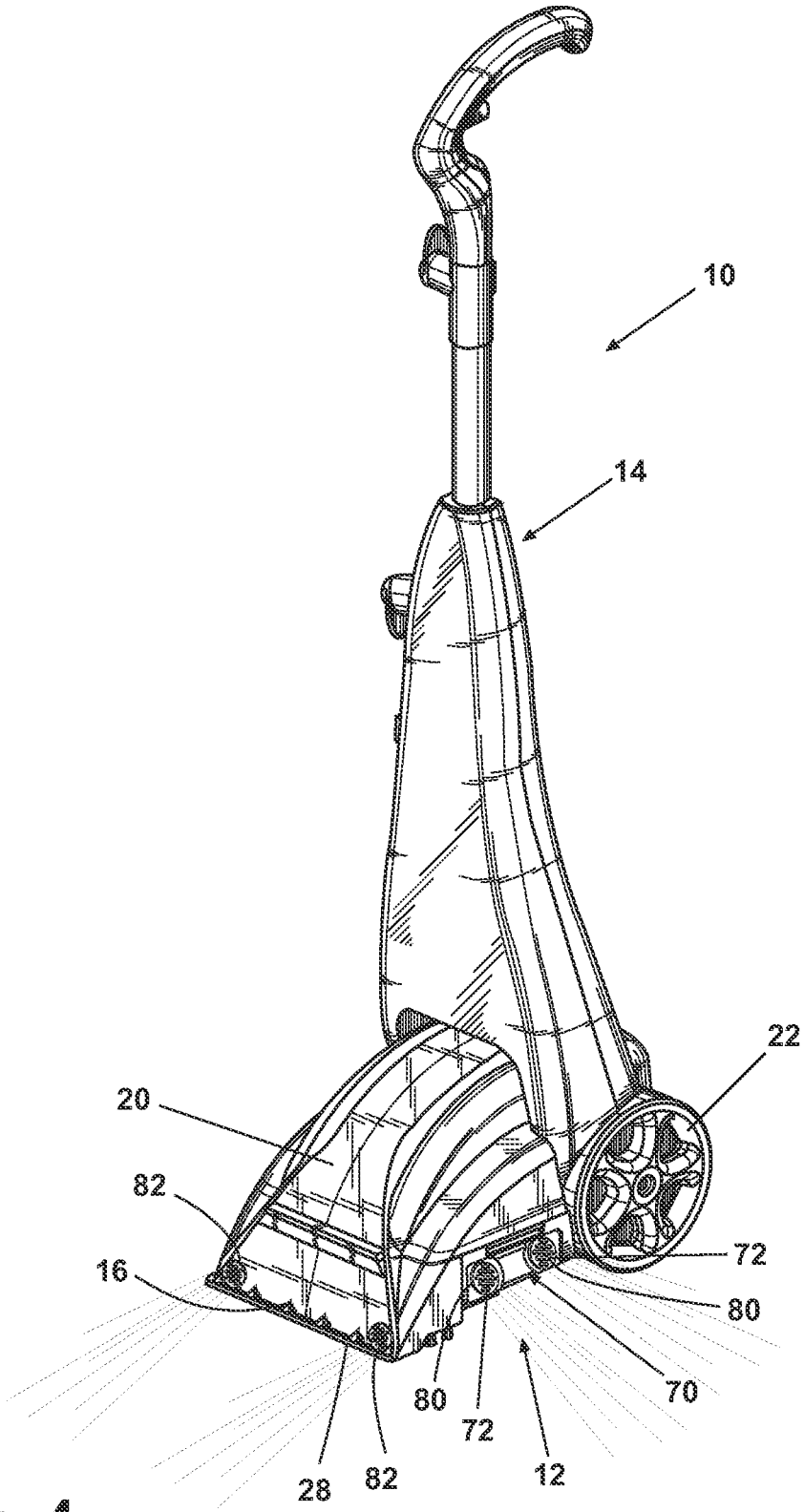
FIG. 4 is a perspective view of an upright extraction cleaning machine comprising a base module and a handle assembly, and a third and fourth embodiment of a blower assembly according to the invention.

FIG. 4 illustrates a third and fourth embodiment of the blower assembly 70 in which the blowers 72 are mounted in a lower portion of the housing 20. FIG. 4 illustrates a pair of blowers 72 mounted in one lateral wall of the housing 12 for delivery of air laterally away from the extraction cleaning machine 10 in a first direction transverse to the direction of movement of the cleaning machine. It will be understood that an identical pair of blowers 72 is mounted in the opposed lateral wall of the housing 12 for delivery of air laterally away from the extraction cleaning machine 10 in a second, opposed direction. It has been found that airflow along the surface to be cleaned from a blower assembly located at the surface generates much less noise than a blower which is elevated above the surface.

FIG. 4 further illustrates another set of blowers 82 that can be used in addition to or in lieu of the blowers 72. These blowers 82 are adapted to direct drying air in a direction of the movement of the cleaning machine 10 during the cleaning process.

Figure 5:
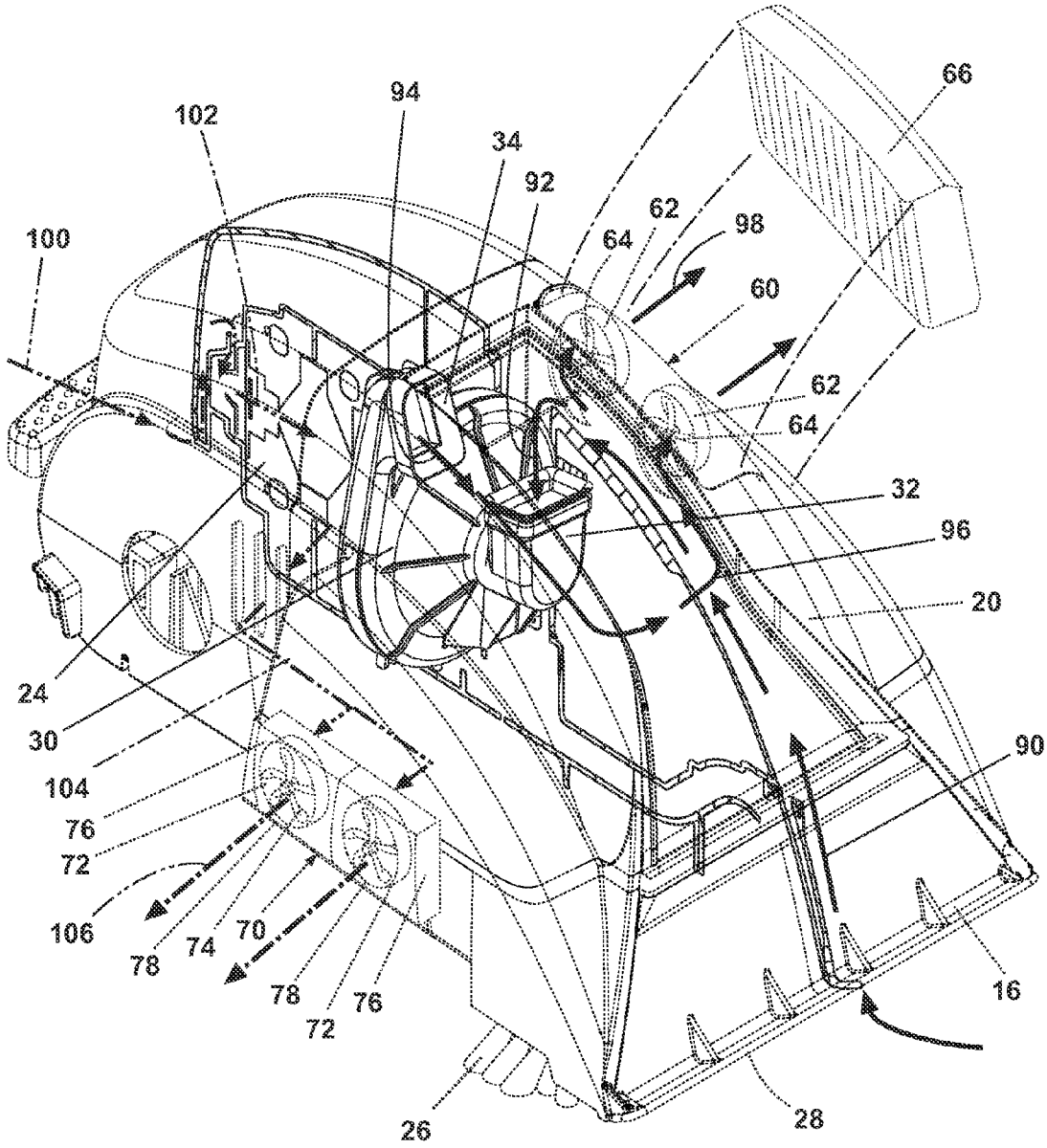
FIG. 5 is a phantom perspective view of the base module of FIG. 1 illustrating motor cooling air flow and working air flow through the base module and blower assemblies.

FIG. 5 illustrates in a single view the location and airflow associated with each embodiment. In the embodiment comprising the blower assembly 60, air discharged by fans 64 through a grille 66 originates with air vacuumed into the cleaning machine 10 through the vacuum inlet 28. Such air is referred to as "working air" and contains liquid removed from the surface to be cleaned which is separated from the air and retained in a reservoir in the extraction cleaning machine for later disposal. In a well-known manner, air, represented by the airflow vector 90, flows through the vacuum inlet 28 and into a vacuum blower inlet 32, represented by the airflow vector 92. Air is exhausted from the vacuum blower 90 through a vacuum blower outlet 34, as represented by the airflow vector 94, and to a conventional recovery tank (not shown) that separates liquid from air. Air exhausted from the separation process is delivered to the blowers 62 through suitable airflow conduits or channelways (not shown), as represented by the airflow vector 96. The air is discharged along the surface by the blowers 62, as represented by the airflow vector 98. It will be understood that the airflow generating portion of the blower assemblies 40, 60, 70, 82, 120 can be eliminated and the airflow can be generated by the vacuum blower 30 and using either working air or motor cooling air to dry the surface.

It will also be understood that air discharged from the blower assembly 60 can originate elsewhere, such as through one or more inlets in the housing 20 established specifically for providing air to the blower assembly 60, or as air originating as cooling air for the motor assembly 24. In FIG. 5, air discharged from the blower assembly 70 is illustrated as originating as cooling air for the motor assembly 24. Typically, cooling air for the motor assembly 24, represented by the airflow vector 100, is drawn into the housing 20 through one or more inlets in the housing 20. The air is routed through the motor assembly 24, represented by the airflow vector 102, and cools the motor assembly 24. The air is then routed through suitable conduits or channelways (not shown), represented by the airflow vector 104, to the blower assembly 70. The air is discharged along the surface by the blowers 72, as represented by the airflow vector 106.

Figure 6:
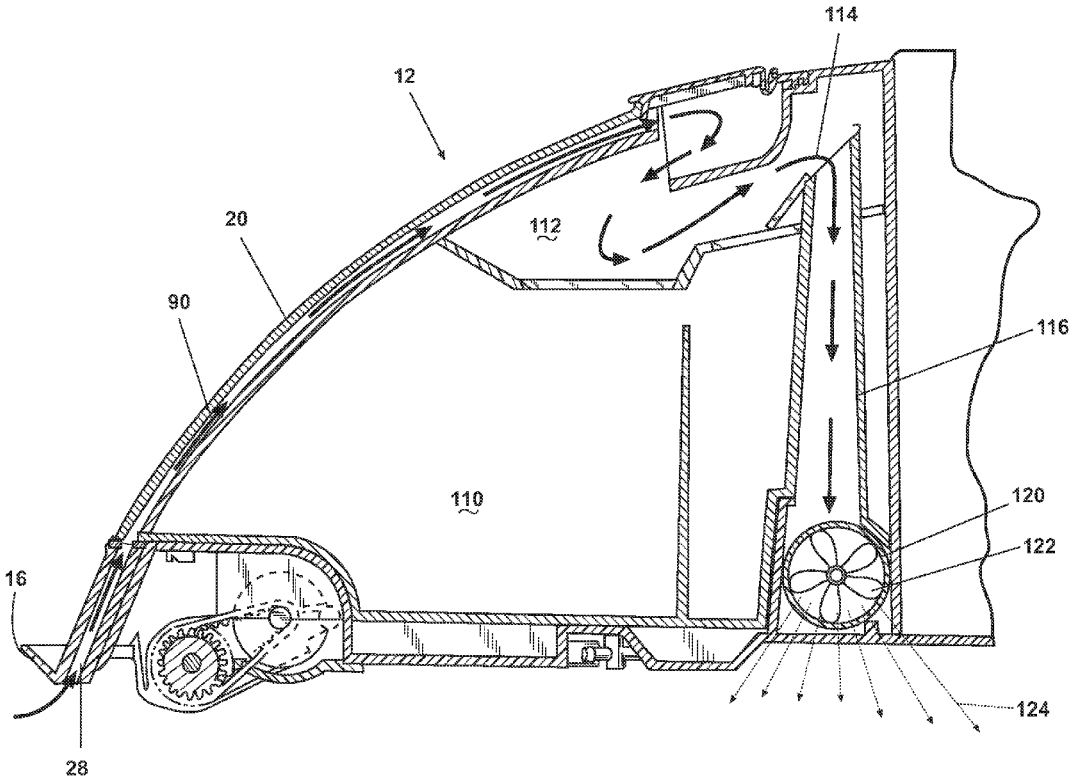
FIG. 6 is a sectional view of a base module comprising a fifth embodiment of a blower assembly according to the invention.

FIG. 6 illustrates a fifth embodiment in which the vacuum inlet 28 leads to a baffle chamber 112 where the vacuumed liquid is separated from the air and received in a recovery tank 110 for later disposal in a well-known manner. The baffle chamber 112 is fluidly connected to a standpipe 116. The standpipe 116 terminates in a blower assembly 120 comprising a fan 122 adapted to discharge air along the surface in a manner similar to the blower assembly 70 illustrated in FIG. 4. Air is drawn through the vacuum inlet 28, represented by the airflow vector 90, through the baffle chamber 112, represented by the airflow vector 114, through the standpipe 116 and out the blower assembly 120 along the surface, represented by the airflow vector 124.

Figure 7:
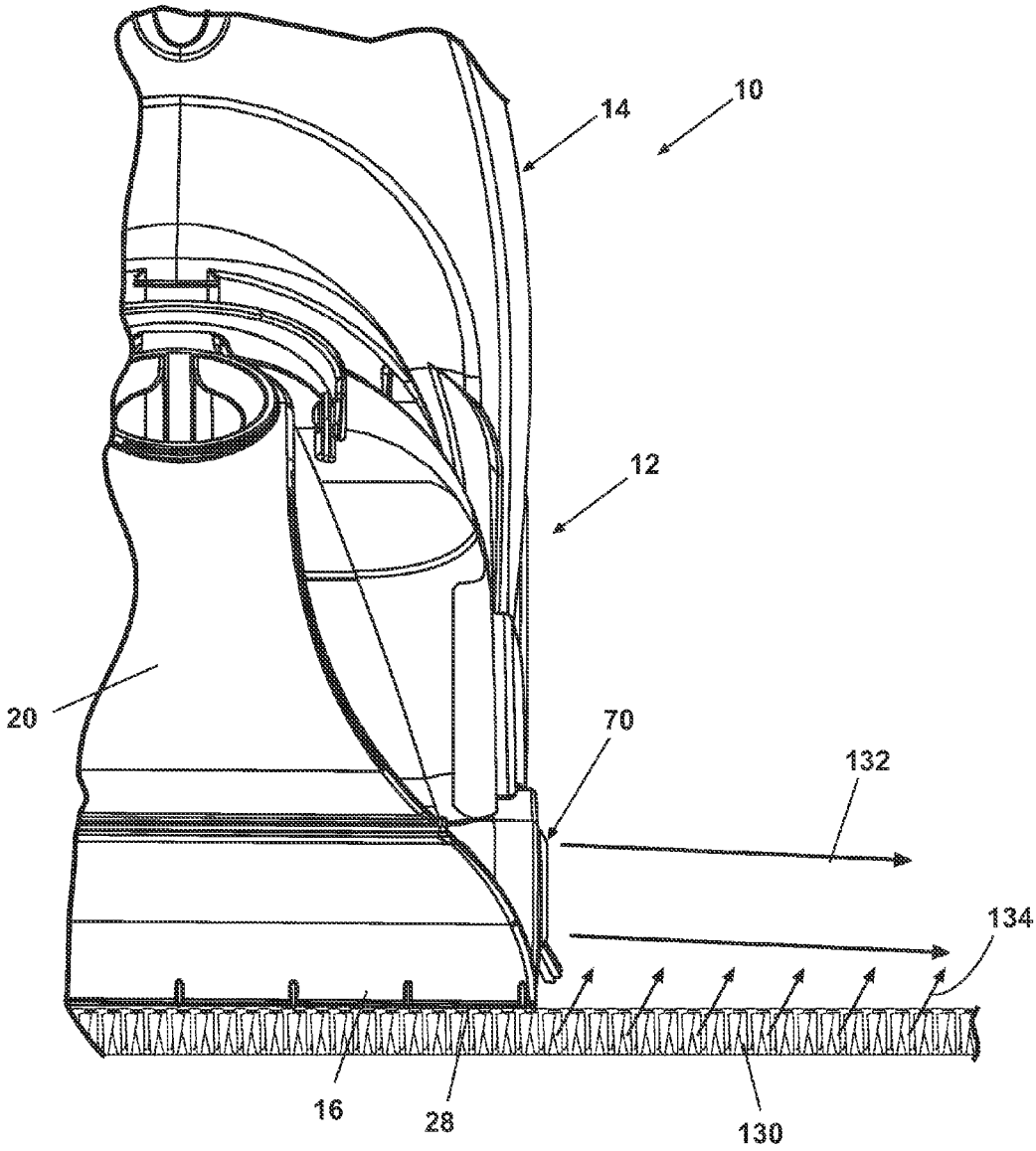
FIG. 7 is a partial front elevational view of the base module illustrated in FIG. 3 showing the migration of water from a surface under the influence of air flow from a blower assembly.

As illustrated in FIG. 7, airflow 132 over a wet carpet surface from any of the herein-described blower assemblies will accelerate the removal of moisture 134 from the wet carpet 130. The relatively high velocity of the airflow 132 will establish a forced convection current at the carpet 130 surface which facilitates the movement of moisture 134 out of the carpet 130 and into the ambient air.

The blower assemblies described and illustrated herein have been configured as delivering air laterally away from the extraction cleaning machine. However, blowers can also be configured to deliver air forward and rearward of the extraction cleaning machine, either in combination with the configurations described herein, or in substitution therefor. The greater the airflow, the better, however, the blower assemblies will have an airflow of 20-100 cubic feet per minute, typically 30 cubic feet per minute, to deliver air at a relatively high flow a distance of several yards from the extraction cleaning machine. Depending upon the distance from the extraction cleaning machine over which the air is to flow for drying the surface, the blower assembly airflow can exceed 100 cubic feet per minute. The blower assemblies can also have movable grilles mounted in a rotatable housing so that airflow can be focused or directed to selected locations away from the extraction cleaning machine. The blower assemblies can also be provided with air cleaning devices, such as filters or electrostatic precipitators, desiccant filters for dehumidification of the air, fragrance delivery packages for introducing fragrance into the air, timers for controlling the length of time the blower is operated, and the like. Additionally, the handle mounted blower assembly 40 illustrated in FIG. 1 can be configured with its own power supply, including a separate power cord, and controls to be removable from the extraction cleaning machine to be used as a stand-alone continuous use blower system.

The auxiliary high flow blower will accelerate the drying of cleaned, wet surfaces by the delivery of air at a high velocity tangentially across the surface, thereby accelerating the migration of moisture from the surface and shortening the drying time during which the surface is out of service. Dry ambient air can be utilized, as well as heated air. Heating of the air can be accomplished by dedicated heating elements in each blower assembly, or by utilizing cooling air from the motor assembly.

While the invention has been specifically described in connection with certain specific embodiments thereof, it is to be understood that this is by way of illustration and not of limitation. For example, the blowing of the air can take place exclusively of the normal operation of the extraction process with the use of the same equipment. For example, the extraction machine can be parked in a room after the extraction, with our without blowing the air across the surface that has been cleaned with only the blower operating to dry the cleaned surface of the room without operator control of the extractor. Reasonable variation and modification are possible within the scope of the forgoing disclosure and drawings without departing from the spirit of the invention which is defined in the appended claims.

What is claimed is:

1. A portable cleaning apparatus, comprising:

a housing for movement along a surface;

a cleaning liquid dispensing system mounted in the housing for applying a cleaning liquid to a surface to be cleaned;

a suction nozzle and a suction source both coupled with the housing and the suction source having an inlet functionally connected to the suction nozzle for removing a portion of the liquid from the surface to be cleaned; and a blower assembly coupled with the housing and unassociated with the movement of air driven by the suction source, for discharging air from the housing laterally along the surface that has been cleaned to dry the surface subsequent to the removal of the portion of liquid from the surface through the suction nozzle.

2. A method for cleaning a surface comprising the steps of:

depositing a cleaning fluid on the surface;

entraining dirt and debris in the cleaning fluid;

extracting the cleaning fluid with the entrained dirt and debris from the surface;

collecting the extracted cleaning fluid with the entrained dirt and debris; and subsequent to the extracting step, discharging air laterally along the surface, from a source unassociated with a fluid extracting suction source, to dry the cleaning fluid from the surface.

3. A method for cleaning a surface according to claim 2 wherein the depositing, extracting, collecting and discharging steps are performed sequentially in a single implement.

4. A method for cleaning a surface according to claim 2 wherein the air is discharged along the surface at a rate of at least 20 cubic feet per minute.

5. A method for cleaning a surface according to claim 2 wherein the air is discharged along the surface at a rate of about 30 cubic feet per minute.

6. A method for cleaning a surface according to claim 2 wherein the air is discharged along the surface at a rate of between 20 and 100 cubic feet per minute.

7. A method for cleaning a surface according to claim 2 wherein the discharging step is performed exclusively of the depositing, extracting, collecting steps.

8. A method for cleaning a surface according to claim 7 wherein the depositing, extracting, collecting and discharging steps are performed sequentially in a single implement.

9. A method for cleaning a surface according to claim 2 wherein the depositing step includes the step of sequentially depositing the cleaning fluid along the surface in a first direction and the discharging step includes the step of discharging the air along the surface in the first direction.

10. A method for cleaning a surface according to claim 2 wherein the depositing step includes the step of sequentially depositing the cleaning fluid along the surface in a first direction and the discharging step includes the step of discharging the air along the surface in a direction transverse to the first direction.

11. A portable cleaning apparatus, comprising:

a base module adapted for movement along a surface, the base module having a base housing with a front end and an opposed rear end;

a cleaning liquid dispensing system for applying a cleaning liquid to the surface;

an extraction system for removing cleaning liquid from the surface; and a surface dryer assembly having an outlet opening adjacent the surface at the front end of the base housing for discharging drying air laterally along the surface.

12. A portable cleaning apparatus, comprising:

a housing for movement along a surface, a cleaning liquid dispensing system mounted in the housing for applying a cleaning liquid to a surface to be cleaned; and a suction nozzle and a suction source both mounted on the housing and the suction source having an inlet functionally connected to the suction nozzle for removing a portion of the liquid from the surface to be cleaned; and a blower assembly mounted on the housing for discharging air from the housing laterally along the surface that has been cleaned to dry the surface subsequent to the removal of the portion of liquid from the surface through the suction nozzle.

13. The portable cleaning apparatus of claim 12 wherein the suction source includes a motor, the housing has an opening in fluid communication with the motor for cooling the motor and the blower assembly is in fluid communication with the motor to draw motor cooling air from the motor.

14. The portable cleaning apparatus of claim 12 wherein the blower assembly is fluidly connected to an outlet of the suction source.

15. The portable cleaning apparatus of claim 12 wherein the blower assembly further comprises a heating element for heating the air prior to discharging the air along the surface.

16. The portable cleaning apparatus of claim 12 wherein the blower assembly is capable of discharging the air along the surface at a rate of at least 20 cubic feet per minute.

17. The portable cleaning apparatus of claim 12 wherein the blower assembly is capable of discharging the air along the surface at a rate of between 20 and 100 cubic feet per minute.

18. The portable cleaning apparatus of claim 17 wherein the blower assembly is capable of discharging the air along the surface at a rate of about 30 cubic feet per minute.

19. The portable cleaning apparatus of claim 12 wherein the housing includes a base module that is adapted to move along the surface to be cleaned and an upright handle pivotally attached to the base module; and the blower assembly outlet opening is positioned in the base module.

20. The portable cleaning apparatus of claim 12 wherein the housing includes a base module that is adapted to move along the surface to be cleaned and an upright handle pivotally attached to the base module; and a blower assembly outlet opening is positioned on the handle.

21. The portable cleaning apparatus of claim 12 wherein the housing has a forward and reward portion and the housing is adapted for movement in forward and rearward directions and the blower assembly has an outlet opening in a forward or rearward portion to discharge the air in at least one of a forward and rearward direction.

22. The portable cleaning apparatus of claim 12 wherein the housing has a forward and reward portion and the housing is adapted for movement in forward and rearward directions and the blower assembly has an outlet opening in a side portion to discharge the air in a direction transverse to the forward and rearward directions of movement of the housing.

* * * * *